US006070744A

United States Patent [19]

Levinson et al.

[11] Patent Number: 6,070,744

[45] Date of Patent: Jun. 6, 2000

[54] DISPLAY ASSEMBLY

[76] Inventors: Lawrence Levinson; Eric L. Levinson, both of 6 Vanderbilt Dr., Livingston, N.J. 07039; Jared S. Levinson, 220 Clarken Dr., West Orange, N.J. 07052

[21] Appl. No.: 09/079,227

[22] Filed: May 15, 1998

[51] Int. Cl.[7] ..... B42F 17/00; G09F 3/18

[52] U.S. Cl. ..... 211/50; 211/96; 40/651; 40/642.02

[58] Field of Search ..... 211/50, 55, 88.01, 211/94.01, 56, 96, 126.13, 94.02; 40/124.2, 651, 617, 642.02, 654.01, 649; 206/215, 731–739, 449, 464, 470, 773–774

[56] References Cited

U.S. PATENT DOCUMENTS

| | | | |
|---|---|---|---|
| D. 255,753 | 7/1980 | Hoffman et al. | 206/373 X |
| D. 267,383 | 12/1982 | Liptak et al. | 40/124.2 X |
| 3,319,369 | 5/1967 | Severson | 40/654.01 |
| 3,958,788 | 5/1976 | Feibelman | 40/617 |
| 4,051,615 | 10/1977 | Gosanko et al. | 40/661 |
| 4,144,661 | 3/1979 | Gosanko et al. | 40/661 |
| 4,281,469 | 8/1981 | Feibelman | 40/617 |
| 4,460,095 | 7/1984 | Kessler et al. | 211/50 |
| 4,821,437 | 4/1989 | Abramson et al. | 40/642.02 |
| 4,821,440 | 4/1989 | Dunn | 40/642.02 |
| 5,094,349 | 3/1992 | DeVito | 211/50 |
| 5,165,649 | 11/1992 | Neumann et al. | 211/50 |
| 5,526,943 | 6/1996 | Thompson | 211/50 |
| 5,595,300 | 1/1997 | Paik et al. | 206/449 |
| 5,607,067 | 3/1997 | Morrissey | 211/50 |
| 5,800,027 | 9/1998 | Dunn | 40/124.2 |
| 5,931,316 | 8/1999 | Carpinelli | 211/50 |

*Primary Examiner*—Daniel P. Stodola
*Assistant Examiner*—Jennifer E. Novosad
*Attorney, Agent, or Firm*—Arnold D. Litt, Esq.

[57] ABSTRACT

The display assembly includes an elongated support member attached to a supporting surface upon which the display assembly is adapted for attachment. The support member includes a downwardly extending flange with at least one opening formed in the downwardly extending flange. The display assembly also includes at least one display holder adapted for releasably receiving merchandise information such that the merchandise information is presented to consumers as they move past the display assembly. The display holder includes a U-shaped clip hook which is shaped and dimensioned for releasable receipt in the opening formed in the downwardly extending flange such that the display holder is pivotally mounted to the elongated support member.

19 Claims, 2 Drawing Sheets

DISPLAY ASSEMBLY

BACKGROUND OF THE INVENTION

1. Field of the Invention

The invention relates to display assemblies. More particularly, the invention relates to display assemblies providing an appealing and highly visible presentation for consumers for passing nearby.

2. Description of the Prior Art

Retail space is very expensive and it is desirable for retailers to display a large number of products in small space. As such, it is often advantageous for retailers to display product information at high visibility locations, while storing the products apart from the product information.

Such displays are especially effective where the consumer does not feel a need to see the product before deciding whether to purchase the product. Rather the consumer may make a purchase decision by merely reading product information provided at a specific location. For example, such displays are often effective when selling computer software, office supplies or products that are simply too big for displaying within a store. When these displays are used, the consumer generally takes a merchandise voucher from the display, or writes down the product information on a sheet of paper, and goes to a location within the store where the product may be purchased.

It is also desirable to only provide product information where the product is very expensive and it may be risky to leave the product openly displayed for consumers. As with the prior displays, information regarding the product is provided for the consumer but the consumer must go to a remote secure location to purchase the product.

Where a retailer determines that it is desirable to display products while storing the actual products at a remote location, the retailer must find a method for effectively displaying the product so that consumers are not substantially inconvenienced by not having the product readily available. Such a display should be appealing, highly visible and provide consumers with all the information required to make a purchase decision.

Prior displays have been used. However, these displays have failed to effectively achieve all of the merchandise goals of retailers. As such, a need exists for a display assembly providing consumers with an appealing, highly visible and informative display. The present invention provides such a display.

SUMMARY OF THE INVENTION

It is, therefore, an object of the present invention to provide a display assembly. The display assembly includes an elongated support member having means for attachment to a supporting surface upon which the display assembly is adapted for attachment. The support member includes a downwardly extending flange with at least one opening formed in the downwardly extending flange. The display assembly also includes at least one display holder adapted for releasably receiving merchandise information such that the merchandise information is presented to consumers as they move past the display assembly. The display holder includes a U-shaped clip hook which is shaped and dimensioned for releasable receipt in the opening formed in the downwardly extending flange such that the display holder is pivotally mounted to the elongated support member.

It is also an object of the present invention to provide a display assembly including a plurality of display holders, wherein the elongated support member includes a plurality of openings formed in the downwardly extending flange to respectively and pivotally support the plurality of display holders.

It is another object of the present invention to provide a display assembly wherein the elongated support member includes a recess formed rearwardly of the downwardly extending flange, the recess including at least one pocket adapted for storing merchandise vouchers which a consumer may retrieve for use in purchasing desired merchandise.

It is a further object of the present invention to provide a display assembly wherein at least one pocket is aligned with at least one opening and at least one display holder such that at least one pocket is covered by at least one display holder.

It is also an object of the present invention to provide a display assembly including a display support sleeve coupled to the downwardly extending flange, wherein the display support sleeve is shaped and dimensioned to releasably receive merchandise information.

It is another object of the present invention to provide a display assembly wherein the display support sleeve is substantially C-shaped and extends along the length of the elongated support member.

It is a further object of the present invention to provide a display assembly wherein the display holder includes a body with the clip hook integrally formed with the body such that the display holder may be pivotally supported on the elongated support member, and the body includes a clear front panel and a rear panel facing the front panel such that merchandise information may be selectively supported within the body of the display holder.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
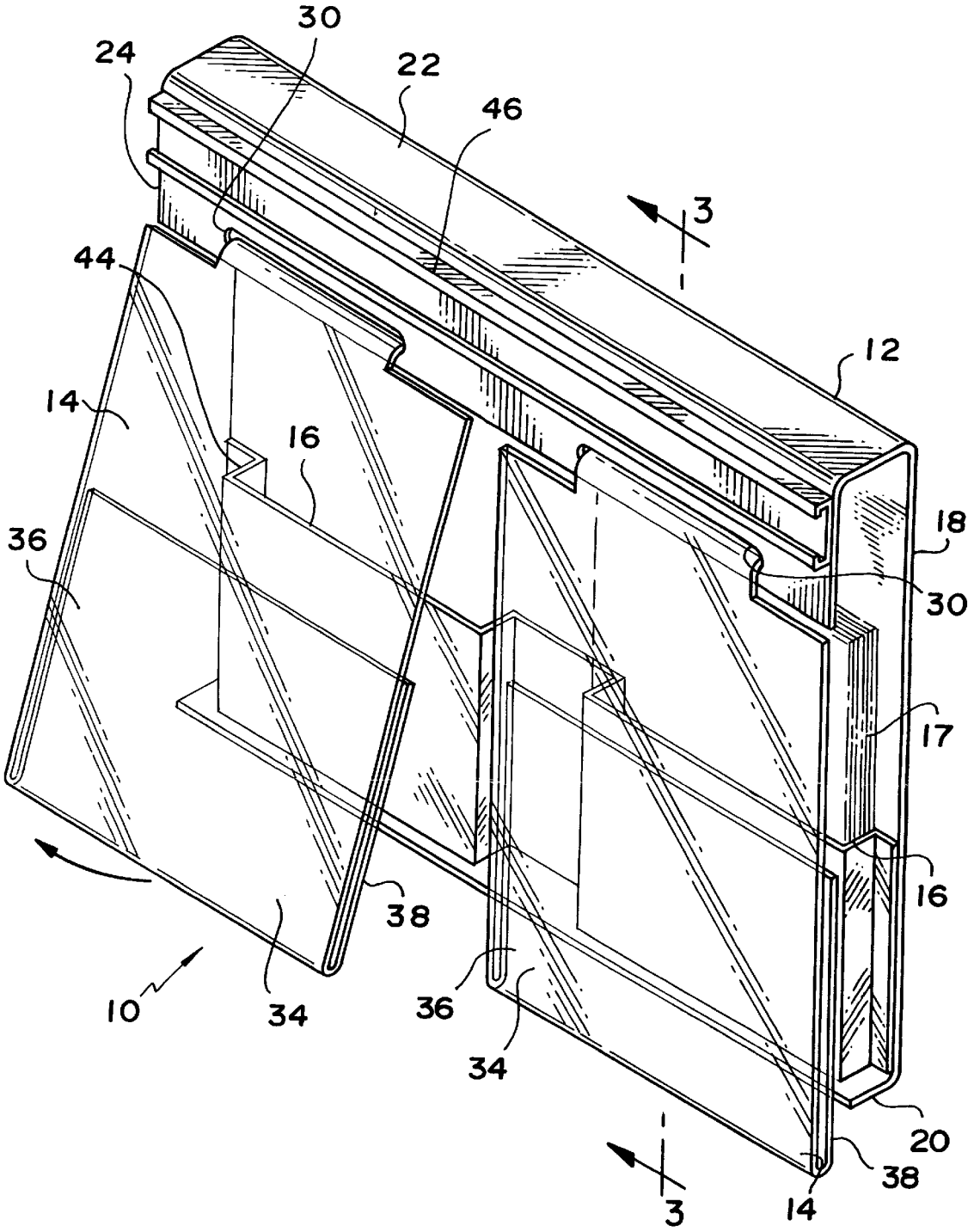
FIG. 1 is a front perspective view of the present display assembly.
Figure 2:
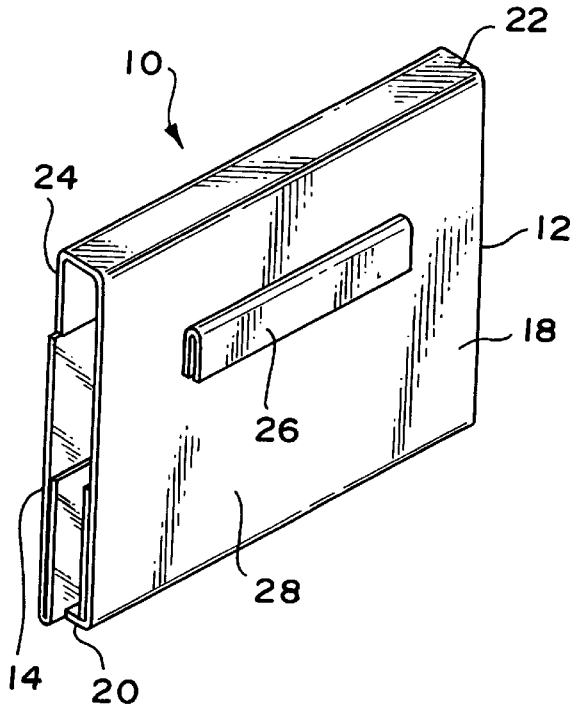
FIG. 2 is a rear perspective view of the present display assembly.
Figure 3:
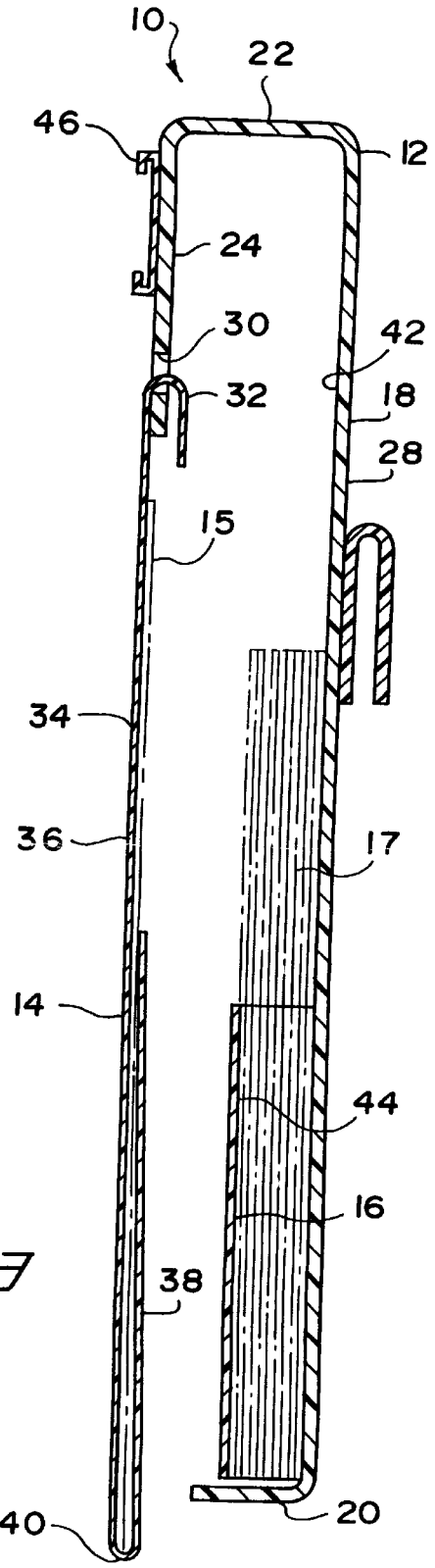
FIG. 3 is a cross sectional view along the line III—III of FIG. 1.

With reference to FIGS. 1–3, a display assembly 10 is disclosed. The display assembly 10 includes an elongated support member 12, one or more display holders 14 releasably supporting merchandise information 15 for viewing by consumers and a plurality of pockets 16 storing merchandise vouchers 17 which a consumer may retrieve for use in purchasing desired merchandise.

The elongated support member 12 is an elongated member adapted for pivotally supporting one or more display holders 14. While the elongated support member 12 shown in FIG. 1 is designed to support two display holders 14, the elongated support member 12 may be manufactured to support any number of display holders 14 without departing from the spirit of the present invention. With this in mind, the elongated support member 12 is substantially C-shaped and includes a rear wall 18, a bottom wall 20, a top wall 22 and a downwardly extending flange 24 depending from the top wall 22. The elongated support member 12 is preferably manufactured from a hard or substantially rigid plastic. In accordance with the preferred embodiment of the present invention, the elongated support member 12 is fabricated using various shaping techniques, although a variety of manufacturing processes may be employed without departing from the spirit of the present invention.

A mounting member 26 is coupled to the back side 28 of rear wall 18 of the elongated support member 12 such that the mounting member 26 faces rearwardly to engage a support surface upon which the display assembly 10 is adapted for attachment. In accordance with the preferred embodiment of the present invention, the mounting member 26 is a U-shaped hook designed to releasably engage a support shelf. While a U-shaped hook is disclosed in accordance with the preferred embodiment of the present invention, other mounting members may be used without departing from the spirit of the present invention.

The downwardly extending flange 24 includes a plurality of openings 30 shaped and dimensioned to receive the display holders 14. The openings 30 are substantially oval shaped and receive clip hooks 32 of the display holders 14. In this way, the display holders 14 are supported for pivotal movement relative to the elongated support member 12. The pivotal movement of the display holders 14 provides a consumer with access to the pockets 16 in a manner that will be discussed in greater detail below.

Each display holder 14 includes a clip hook 32 integrally formed with the display holder body 34. As discussed above, the clip hook 32 is shaped and dimensioned for receipt within the openings 30 formed in the downwardly extending flange 24. The shape of the clip hook 32 allows an individual to easily replace the display holders 14 within the downwardly extending flange 24 by simply removing the clip hook 32 from within the opening 30, either by lifting or sliding the clip hook from the opening. In contrast, however, the shape of the clip hook 32 prevents the display holders 14 from inadvertently releasing from the downwardly extending flange 24 as a consumer pivots the display holder 14 relative to the elongated support member 12, in order to access the pockets 16, behind the display holder.

The body 34 of the display holder 14 includes a clear front panel 36 and a rear panel 38 facing the front panel 36 such that merchandise information 15 may be selectively supported within the body 34 of the display holder 14. Specifically, the display holder 14 is fabricated from a unitary piece of clear, substantially rigid plastic with the front panel 36 coupled to the rear panel 38 by a bottom connection member 40. The bottom connection member 40 resiliently biases the rear panel 38 toward the front panel 36 to hold desired merchandise information 15 between the front panel 36 and rear panel 38. However, the front and rear panels 36, 38 may be easily separated when an individual desires to replace the merchandise information 15 stored within the display holder 14. In a preferred embodiment of this invention, and because of the preferred U-shaped configuration of the display holder, merchandise information will only appear on one side thereof.

The C-shaped elongated support member 12 creates a recess 42 in which pockets 16 are situated, in one embodiment of the invention. Specifically, a plurality of pocket walls 44 are coupled to the rear wall 18 of the elongated support member 12. The pocket walls 44 define a plurality of pockets 16 in which merchandise vouchers 17, for example, may be positioned for retrieval by consumers. The pockets 16 are aligned with the openings 30 formed in the downwardly extending flange 24 and the display holders 14 such that the pockets 16 are hidden behind the display holders 14 when the display holders 14 are freely supported from the downwardly extending flange 24.

The pockets 16, and the merchandise vouchers 17 stored therein, are revealed when a consumer pivots the display holders 14 upwardly. In this way, the pockets 16, and merchandise vouchers 17 stored therein, sit behind the display holders 14 until a consumer determines that he or she would like to retrieve the information held within the pocket 16 directly behind a specific display holder 14. The consumer may then rotate the display holder 14 upwardly revealing the pocket 16 behind the display holder 14. Without deviating from the objectives of this invention, it is not a necessary component of this invention that pocket 16 be incorporated in the display assembly; rather, the pockets described herein only relate to one embodiment of the invention.

The display assembly 10, in one embodiment of the invention, also includes a display support sleeve 46 coupled to the downwardly extending flange 24. The display support sleeve 46 is shaped and dimensioned to releasably receive merchandise information 15. The display support sleeve 46 is substantially C-shaped and extends along the length of the elongated support member 12. The C-shaped sleeve 46 allows individuals to readily slide merchandise information within the sleeve for presentation to consumers. In this way, the display support sleeve 46, the display holder 14, and the pocket 16 may be effectively employed to provide consumers with required product information in a very small space.

In accordance with the preferred use of the present display assembly 10, merchandise information 15 is placed within each display holder 14. A merchandise voucher 17 for purchasing the merchandise displayed in the display holder 14 is placed within the pocket 16 directly behind the display holder 14. The merchandise information appears on one side of an insert sheet which is inserted into the display holder. When a consumer wishing to purchase the displayed merchandise arrives at the display location, he or she may review the merchandise information 15 displayed through the front panel 36 of the display holder 14. If, after reviewing the relevant information, the consumer wishes to purchase the merchandise, he or she simply pivots the display holder 14 up to reveal the merchandise vouchers 17 held within the pocket 16 directly behind the display holder 14. While the present display assembly 10 has been described for use in distributing merchandise vouchers, the present display assembly may be employed to distribute a variety of information without departing from the spirit of the present invention.

The components of the present display assembly are preferably formed from hard or substantially rigid plastics. However, the display assembly may be fabricated from a variety of materials without departing from the spirit of the present invention.

While the preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A display assembly, comprising:

an elongated support member including means for attachment to a supporting surface, the support member including a downwardly extending flange with at least one opening therethrough;

at least one display holder adapted for releasably receiving merchandise information, comprising top and bottom portions, the display holder including at the top portion a downwardly opening U-shaped clip hook which is shaped and dimensioned for releasable receipt in the opening formed in the downwardly extending flange such that the display holder is pivotally mounted to the elongated support member; and wherein the display holder includes an upwardly opening receiving portion located at the bottom portion of said display holder for receiving merchandise information.

2. The display assembly according to claim 1, further including a plurality of display holders and wherein the elongated support member includes a plurality of openings formed in the downwardly extending flange to respectively and pivotally support the plurality of display holders.

3. The display assembly according to claim 1, wherein the elongated support member includes a recess formed rearwardly of the downwardly extending flange, the recess including at least one pocket adapted for storing merchandise vouchers which a consumer may retrieve for use in purchasing desired merchandise.

4. The display assembly according to claim 3, wherein at least one pocket is aligned with at least one opening and at least one display holder such that at least one pocket is covered by at least one display holder.

5. The display assembly according to claim 4, further including a plurality of display holders, and wherein the elongated support member includes a plurality of openings formed in the downwardly extending flange to respectively and pivotally support the plurality of display holders and the elongated support member includes a plurality of pockets covered by the plurality of display holders.

6. The display assembly according to claim 1, further including a display support sleeve coupled to the downwardly extending flange, wherein the display support sleeve is shaped and dimensioned to releasably receive merchandise information.

7. The display assembly according to claim 6, wherein the display support sleeve is substantially C-shaped and extends along the length of the elongated support member.

8. The display assembly according to claim 1, wherein the display holder includes a body with the clip hook integrally formed with the body such that the display holder may be pivotally supported on the elongated support member, the body including a clear front panel and a rear panel facing the front panel such that merchandise information may be selectively supported within the body of the display holder.

9. The display assembly according to claim 1, wherein the display holders and support member are fabricated from hard or substantially rigid plastic.

10. A display assembly, comprising:

an elongated support member including means for attachment to a supporting surface, the support member including a downwardly extending flange with at least one opening formed therein, adapted to pivotally support at least one display holder, wherein at least one display holder is adapted for releasably receiving merchandise information; and the elongated support member includes a recess formed rearwardly of the downwardly extending flange, the recess including at least one pocket adapted for storing merchandise vouchers which a consumer may retrieve for use in purchasing desired merchandise.

11. The display assembly according to claim 10, wherein the downwardly extending flange includes at least one opening and the display holder includes a U-shaped clip hook which is shaped and dimensioned for releasable receipt in the opening formed in the downwardly extending flange such that the display holder is pivotally mounted to the elongated support member.

12. The display assembly according to claim 11, wherein the display holder includes a body with the clip hook integrally formed with the body such that the display holder may be pivotally supported on the elongated support member, the display body including a clear front panel and a rear panel facing the front panel such that merchandise information may be selectively supported within the body of the display holder.

13. The display assembly according to claim 11, further including a plurality of display holders and wherein the elongated support member includes a plurality of openings formed in the downwardly extending flange to respectively and pivotally support the plurality of display holders.

14. The display assembly according to claim 10, wherein at least one pocket is aligned with at least one opening in at least one display holder such that at least one pocket is covered by at least one display holder.

15. The display assembly according to claim 14, further including a plurality of display holders, and wherein the elongated support member includes a plurality of openings formed in the downwardly extending flange to respectively and pivotally support the plurality of display holders and the elongated support member includes a plurality of pockets covered by the plurality of display holders.

16. The display assembly according to claim 10, further including a display support sleeve coupled to the downwardly extending flange, wherein the display support sleeve is shaped and dimensioned to releasably receive merchandise information.

17. The display assembly according to claim 16, wherein the display support sleeve is substantially C-shaped and extends along the length of the elongated support member.

18. The display assembly according to claim 10, wherein the display holder includes a clear front panel and a rear panel facing the front panel thereby defining an opening such that merchandise information may be selectively supported within the opening of the display holder.

19. The display assembly according to claim 10, wherein the display holders and support member are fabricated from hard or substantially rigid plastic.

* * * * *